US007922411B2

(12) United States Patent
Kageyama

(10) Patent No.: US 7,922,411 B2
(45) Date of Patent: Apr. 12, 2011

(54) END PLUG MOUNTING STRUCTURE FOR WRITING INSTRUMENT

(75) Inventor: Hidehei Kageyama, Kawagoe (JP)

(73) Assignee: Kotobuki & Co. Ltd., Saitama-ken (JP)

( * ) Notice: Subject to any disclaimer, the term of this patent is extended or adjusted under 35 U.S.C. 154(b) by 858 days.

(21) Appl. No.: 11/973,241

(22) Filed: Oct. 5, 2007

(65) Prior Publication Data

US 2008/0260453 A1 Oct. 23, 2008

(30) Foreign Application Priority Data

Oct. 6, 2006 (JP) ..... 2006-275131

(51) Int. Cl.
*B43K 23/02* (2006.01)

(52) U.S. Cl. ..... 401/131

(58) Field of Classification Search ..... 401/107, 401/117, 131, 262
See application file for complete search history.

(56) References Cited

U.S. PATENT DOCUMENTS 4,167,350 A * 9/1979 Harris ..... 401/260
7,220,073 B2 * 5/2007 Yoon ..... 401/108

FOREIGN PATENT DOCUMENTS

JP 2004-98434 4/2004

* cited by examiner

*Primary Examiner* — Huyen Le
(74) *Attorney, Agent, or Firm* — Merchant & Gould P.C.

(57) ABSTRACT

An end plug mounting structure for writing instrument of the present invention can securely mount an end plug onto a barrel and remove it more easily. Even if assembling and removing is performed repeatedly, tightness for the end plug to be assembled on the barrel can be prevented from weakening. A locking hole is provided around cylindrical rear portion of the barrel, an inserting portion with circular cross section inserted into rear portion of the barrel from rear end of the barrel is provided on the end plug, a locking protrusion locked in a locking hole is provided at periphery of the inserting portion, a groove extending forward from rear end of the barrel and in which the locking protrusion moves is provided on inner surface of rear portion of the barrel, thereby the end plug is assembled on the barrel by means of locking the locking protrusion that moves forward in the groove in the locking hole. The locking hole is configured to be adjacent to the groove, so that the locking protrusion moving forward in the groove moves in circumferential direction so as to be locked in the locking hole. A protruding strip extending in lengthwise direction is configured on side bottom of the groove on the side of the locking hole, so that the locking protrusion can stride over the protruding strip to move along circumferential direction.

9 Claims, 5 Drawing Sheets

END PLUG MOUNTING STRUCTURE FOR WRITING INSTRUMENT

BACKGROUND

1. Field of the Invention

The present invention generally relates to end plug mounting structure for writing instrument, such as a ball-point pen, a mechanical pencil and so on, used for mounting an end plug onto a barrel.

2. Description of the Related Art

In conventional end plug mounting structures, the known structures are as follows: A locking hole is configured around a rear portion of a barrel, and an inserting portion is provided on an end plug, which is inserted into a circular cross section of the rear portion of the barrel from rear end thereof, so that the end plug can be mounted onto the barrel by means of inserting the inserting portion from rear end of the barrel and locking a locking protrusion into the locking hole. However, in the above existing end plug mounting structure for writing instrument, if the inserting portion is inserted from rear end of the barrel, the locking protrusion provided around the inserting portion of the end plug is then tightly pressed by inner surface of the barrel. Therefore, the locking protrusion tends to be worn and distorted, and it is of concern that the locking protrusion cannot be safely locked into the locking hole.

To resolve this problem, a structure is proposed, which is provided with a groove, in which a locking protrusion moves from rear end of a barrel, on inner surface of rear portion of the barrel by being separated backward along lengthwise direction from the locking hole (for example, refer to patent literature 1). Moreover, in the mounting structure, height of the locking protrusion of the end plug is provided less than depth of the groove formed on inner surface of rear portion of the barrel. In such the end plug mounting structure for a writing instrument, when the locking protrusion is moving forward in the groove, since height of the locking protrusion is less than depth of the groove, the locking protrusion is never pressed onto inner surface of the groove by a larger force. The locking protrusion is pressed only on the portion between front end of the barrel and the locking hole, which is located in front of lengthwise thereof. Therefore, abrasion or distortion of the locking protrusion is no longer a problem. Thus, the locking protrusion can be safely locked in the locking hole, and the end plug can therefore be securely fixed on the barrel. See, patent literature 1: Japanese Patent Laid-open No. 2004-98434 (Paragraphs 0006, 0012 and FIG. 1).

However, in recent years, there begins to be a need to remove the end plug mounted on the barrel from the barrel again. To utilized resources effectively, ideas are proposed as follows: if the writing instrument is a ball-point pen, a ball-point pen refill can be replaced from rear portion of the barrel without special opening mechanism for a barrel on front end, which is required previously. Further, if the writing instrument is a mechanical pencil, an end plug mounted on rear portion of the barrel will be removed from there, and a replacing pencil lead refill can be replenished from rear portion of the barrel.

Hereinafter, the locking protrusion, by which an end plug is fixed on a pen, is locked in the locking hole to prevent the end plug from moving backward with respect to the barrel through face-face contact of rear end face thereof and rear surface facing front of the locking hole. In addition, in the previous end plug mounting structures, since the groove is configured by being separated from the locking hole to backside along a lengthwise direction, thus, in order to remove the end plug from the barrel, the end plug is required to move backward along the lengthwise direction of the barrel after the locking protrusion is knocked inside of the barrel. However, it is difficult to knock the locking protrusion, which is locked in the locking hole, inside the barrel; therefore, there exists a problem that the end plug is difficult to remove.

In addition, in above previous end plug mounting structures, wherein the groove is configured by being separated from the locking hole to backside along lengthwise direction, if the end plug is mounted and removed repeatedly, it may happen that the locking protrusion cannot be fully knocked inside the barrel so as to move the end plug backward. Moreover, in the case that the locking protrusion is made of a material such as resin, there also exists a problem that rear surface of the locking hole or rear end face of the locking protrusion, which is in face-face contact with the rear surface, is distorted to present a circular shape, and a force locking the locking protrusion into the locking hole is weaken gradually, so that the end plug cannot be securely fixed on the barrel.

SUMMARY

An aspect of the present disclosure is to provide an end plug mounting structure for a writing instrument, which allows an end plug to be more securely fixed on a barrel, and to be more easily removed from the barrel.

Another aspect of the present disclosure is to provide an end plug mounting structure for a writing instrument, which can prevent the tightness between the end plug and the barrel from weakening, even through repeated mounting and removing of the end plug.

A first aspect of the present disclosure is illustrated in FIG. 1. A locking hole 12 is provided around the cylindrical rear portion of a barrel 11. An inserting portion 22, which is inserted into a circular cross section of rear portion of the barrel 11 from rear end 11*a* thereof, is provided on an end plug 21. A locking protrusion 24 is provided around periphery of the inserting portion 22, so as to be locked into the locking hole 12. A groove 13, in which the locking protrusion 24 moves, is provided on an inner surface of the rear portion of the barrel 11 and extends forward from rear end 11*a* of the barrel 11. As a result, the end plug 21 is assembled on the barrel 11 by locking the locking protrusion 24, which moves forward in the groove 13, into a locking hole 12.

The structure is characterized by that the locking hole is provided to be adjacent to the groove 13, so that the locking protrusion 24, which moves forward in the groove 13, can move along circumferential direction so as to be locked into the locking hole 12.

In the end plug mounting structure for a writing instrument according to the first aspect, the inserting portion 22 of the end plug 21 is inserted inside rear portion of the barrel 11 from rear end 11*a*, so that the locking protrusion 24 can be moved in the groove 13 to be adjacent to the locking hole 12 inside the groove 13. In this state, by means of rotating the barrel 11 or the end plug 21 about the axis of the barrel 11, the locking protrusion 24 can be locked into the locking hole 12 only through a simple operation of moving the locking protrusion 24 along circumferential direction.

On the other hand, if the barrel 11 or the end plug 21 is rotated about the axis of the barrel 11 in reverse direction of the circumferential direction from the state that the locking protrusion 24 is locked in the locking hole 12, the locking protrusion 24 will be moved along circumferential direction so as to return to the groove 13 from the locking hole 12. Therefore, it is easier to release the state that the locking protrusion 24 is locked in the locking hole 12. Thus, if the end plug is moved backward, the locking protrusion 24 will be moved backward in the groove 13, and thereby, the end plug 21 can be removed from the barrel 11 easily.

In addition, in the present invention recorded in the first aspect, since the locking protrusion 24 is moved along circumferential direction so as to be locked in the locking hole 12, and the locking protrusion 24 is moved along reverse direction of the circumferential direction so as to be released from the locking state, even if the end plug 21 is assembled and removed repeatedly, the rear surface 12*a* of the locking hole 12 and rear end face 24*a* of the locking protrusion 24 which contacts with rear surface 12*a* in locking state would not be distorted. Therefore, even if the end plug 21 is assembled and removed repeatedly, the tightness between the end plug 21 and the barrel 11 will not be weakened.

According to a second aspect of the present disclosure, which is based on the first aspect, a protruding strip 14 extending along lengthwise is provided on bottom surface of the groove 13 on the side of the locking hole 12, and the locking protrusion 24 is configured to move over the protruding strip 14 so as to move along circumferential direction.

In the end plug mounting structure for writing instrument described in the second aspect, since the locking protrusion 24 moves over the protruding strip 14 while the end plug 21 is assembled and removed, a feeling of certainty of suitable movement of the locking protrusion 24 along circumferential direction is provided. Such certainty is desirable when performing such assembling and removing, so that it can be definitely distinguished when the locking protrusion 24 is in the state of being locked in the hole 12 and when the locking protrusion is in the state of being released from such locking state.

A third aspect of the present disclosure is based on the second aspect and characterized by that the locking protrusion 24 is provided with a sunken step portion for avoiding contacting with the protruding strip 14.

In the end plug mounting structure for writing instrument in the third aspect, when the end plug 21 is assembled and removed, although the locking protrusion 24 moves forward or backward inside the groove 13, wear caused by the protruding strip 14 contacting against the locking protrusion 24 can be avoided. Therefore, even if the movement of the locking protrusion 24 along circumferential direction for assembling and removing is performed repeatedly, variation of the feeling of certainty for such movement in circumferential direction can also be avoided.

A fourth aspect of the present disclosure is based on any one of the first three aspects and characterized by that an inserting portion 22 is cylindrical, and a cut groove 27 is configured to extend backward from front end 22*a* of the inserting portion 22.

In the end plug mounting structure for writing instrument described in the fourth aspect, under exterior pressure resulting from the locking protrusion 24 when striding over the protruding strip 14, or in the cases where depth of the groove 13 is configured to be less than height of the locking protrusion 24, as is shown in FIG. 4, the width of the cut groove 27 is narrowed, thereby outer diameter of the cylindrical inserting portion 22 can be reduced. As a result, in the case where the protruding strip 14 is provided on bottom of the groove 13, the locking protrusion 24 can stride more smoothly over the protruding strip 14, the movement along circumferential direction of the locking protrusion becomes easier, and excess wearing of the locking protrusion 24 and the protruding strip 14 caused by repeatedly assembling and removing of the end plug 21 can be avoided.

A fifth aspect of the present disclosure is based on any one of the first four aspects and characterized by that a slot 16, which extends from the groove 13 is configured on rear end 11*a* of the barrel 11, as is shown in FIG. 5.

In the end plug mounting structure for writing instrument described according to the fifth aspect, the slot 16 can be utilized to determine the location of the groove 13, which is difficult to be determined by naked eyes. If the width of the groove 13 is getting narrow in front direction, the locking protrusion 24 can be more easily guided into the groove utilizing the slot 16, which is getting narrow in front direction by means of inserting the locking protrusion 24 into the slot 16.

A sixth aspect of the present disclosure is based on in the fifth aspect and characterized by that, as is further shown in FIG. 6, in cases where the locking protrusion 24 is locked in the locking hole 12, a increased diameter portion 53 with front end 53*a* contacting against rear end 11*a* of the barrel 11 is provided to be coaxial with a inserting portion 53 and extends from the inserting portion 52, and in cases where front end 53*a* of the increased diameter portion 53 contacts against rear end 11*a* of the barrel 11, a covering portion 53*b*, which covers the slot 16, is configured on the increased diameter portion 53.

In the end plug mounting structure for writing instrument described in the sixth aspect, since in the case where the locking protrusion 24 is locked in the locking hole 12, the covering portion 53*b* on the increased diameter portion 53 covers the slot 16, exposure of the slot 16 will be avoided so as to improve beauty of appearance.

A seventh aspect of the present disclosure is based on any one of the first six aspects and characterized by that, as is shown in FIG. 2 and FIG. 6, a clip 28 or 58, which covers the locking protrusion 24, is provided on the end plug 21 or 51.

In the end plug mounting structure for writing instrument described in the seventh aspect, since in the case where the locking protrusion is locked in the locking hole 12, both the locking hole 12 and the locking protrusion 24 are covered by the clip 28 or 58, and a problem caused by exposure of the locking hole 12, which influences the beauty of the appearance, will be prevented.

The effects of the various aspects of the present disclosure will be described as follows.

In the end plug mounting structure for writing instrument according to the aspects of the present disclosure, since the locking hole is configured to be adjacent to the groove, so that the locking protrusion moved forward in the groove is moved along circumferential direction to be locked in the locking hole, the inserting portion of the end plug can be inserted from rear end of the barrel, so that the locking protrusion moved inside the groove is adjacent to the locking hole, and in this state, the locking protrusion can be locked in the locking hole only through such simple operation as moving the locking protrusion along circumferential direction. On the other hand, if the locking protrusion is moved along reverse direction of the circumferential direction from the state that the locking protrusion is locked in the locking hole; the locking protrusion will be returned back to the groove from the locking hole. Therefore, the state that the locking protrusion is locked in the locking hole can be released more easily. Thereby, the assembling and removing of the end plug can be performed more easily.

Moreover, since the locking protrusion is locked in the locking hole through the movement thereof along circumferential direction, and the locking state of the locking protrusion is released through the movement thereof along reverse direction of the circumferential direction, even if the end plug is assembled and removed repeatedly, there is no case that rear surface of the locking hole and rear end face of the locking protrusion 24 which contacts with rear surface in locking state are distorted to be circular. Therefore, even if the end plug is assembled and removed repeatedly, the tightness with which the end plug is assembled on the barrel will not be weakened.

In addition, if a protruding strip extending along lengthwise is provided on bottom surface of the groove on the side of the locking hole, and the locking protrusion is configured to stride over the protruding strip so as to move along circumferential direction, a feeling of certainty for suitable movement of the locking protrusion along circumferential direction, which is required when assembling and removing is performed, can be provided. In such a case, if a sunken step portion is provided on the locking protrusion to avoid contacting with the protruding strip, the case such as wearing caused by the locking protrusion contacting against the protruding strip can be avoided. Moreover, in case that the inserting portion is cylindrical, if a cut groove is configured to extend backward from rear end of the inserting portion, the locking protrusion can be moved more easily to stride over the protruding strip, by means of reducing outside diameter of the cylindrical inserting portion through such as exterior pressure applied when the locking protrusion striding over the protruding strip.

In addition, if a slot, which extends from the groove with width narrowed in front direction and front end narrowed in width, is configured at rear end of the barrel, the slot will be utilized to determine location of the groove, which is difficult to be determined by naked eyes. If the locking protrusion is inserted into the slot, the locking protrusion can be guided into the groove more easily by utilizing the slot having narrowed width in front direction. Moreover, if a covering portion, which covers the slot under the state that the locking protrusion is locked in the locking hole, is provided, the clip will cover both the locking hole and the locking protrusion, so that the locking hole is not exposed, thereby beauty of appearance will not be influenced.

Figure 1:
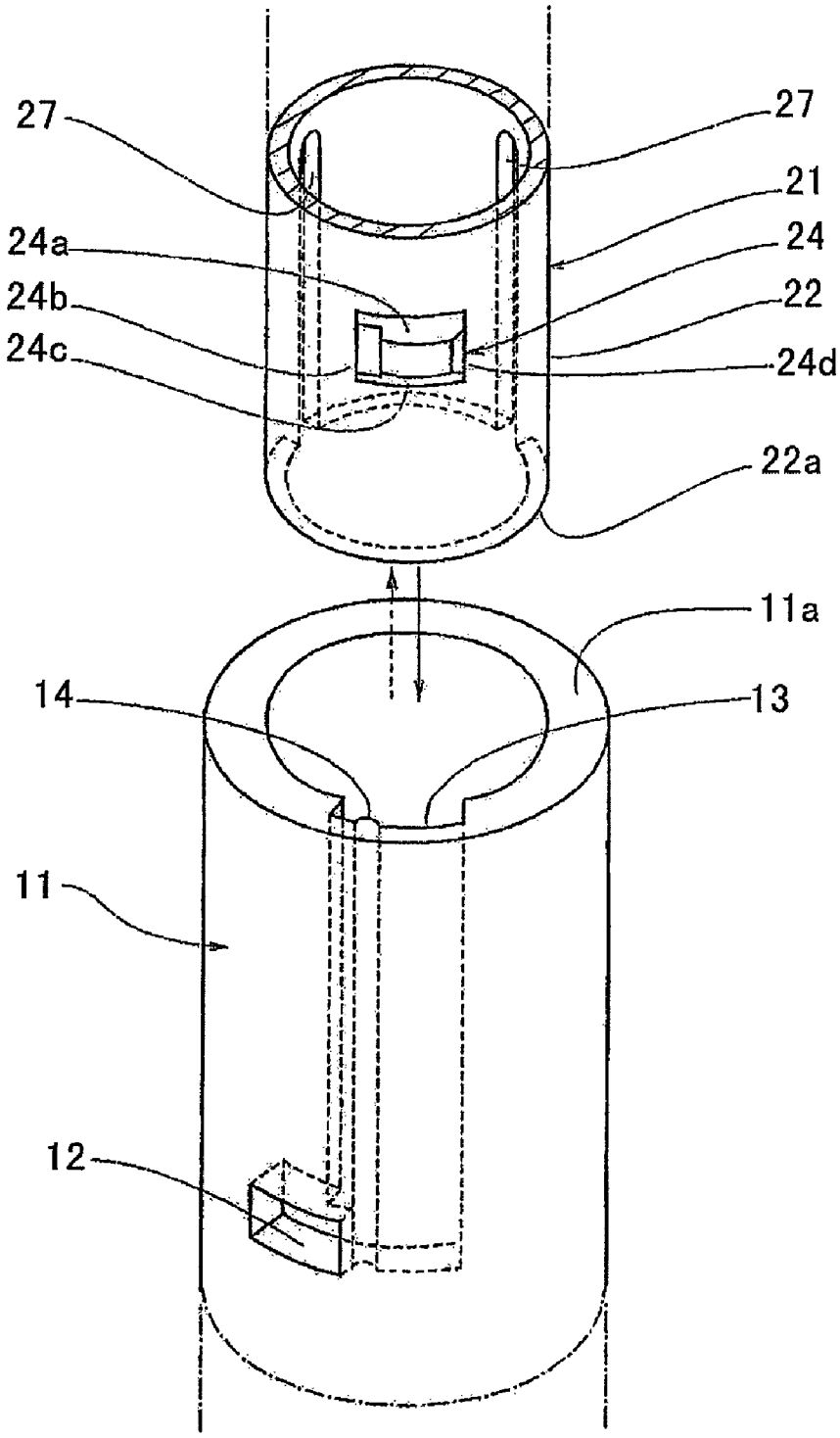
FIG. 1 is an exploded perspective view showing an embodiment of the end plug mounting structure for writing instrument according to one aspect of the present disclosure.

The numerical labels in the drawings are designated as follows:

11—barrel, 11*a*—rear end, 12—locking hole, 13—groove, 14—protruding strip, 16—slot, 21, 51—end plug, 22, 52—inserting portion, 24—locking protrusion, 24*b*—sunken step portion, 27—cut groove, 28, 58—clip, 53—increased diameter portion, 53*a*—front end, 53*b*—covering portion.

DETAILED DESCRIPTION OF THE PREFERRED EMBODIMENTS OF THE INVENTION

The preferred embodiment of the present invention will be described with reference to the accompanying drawings as follows.

Figure 2:
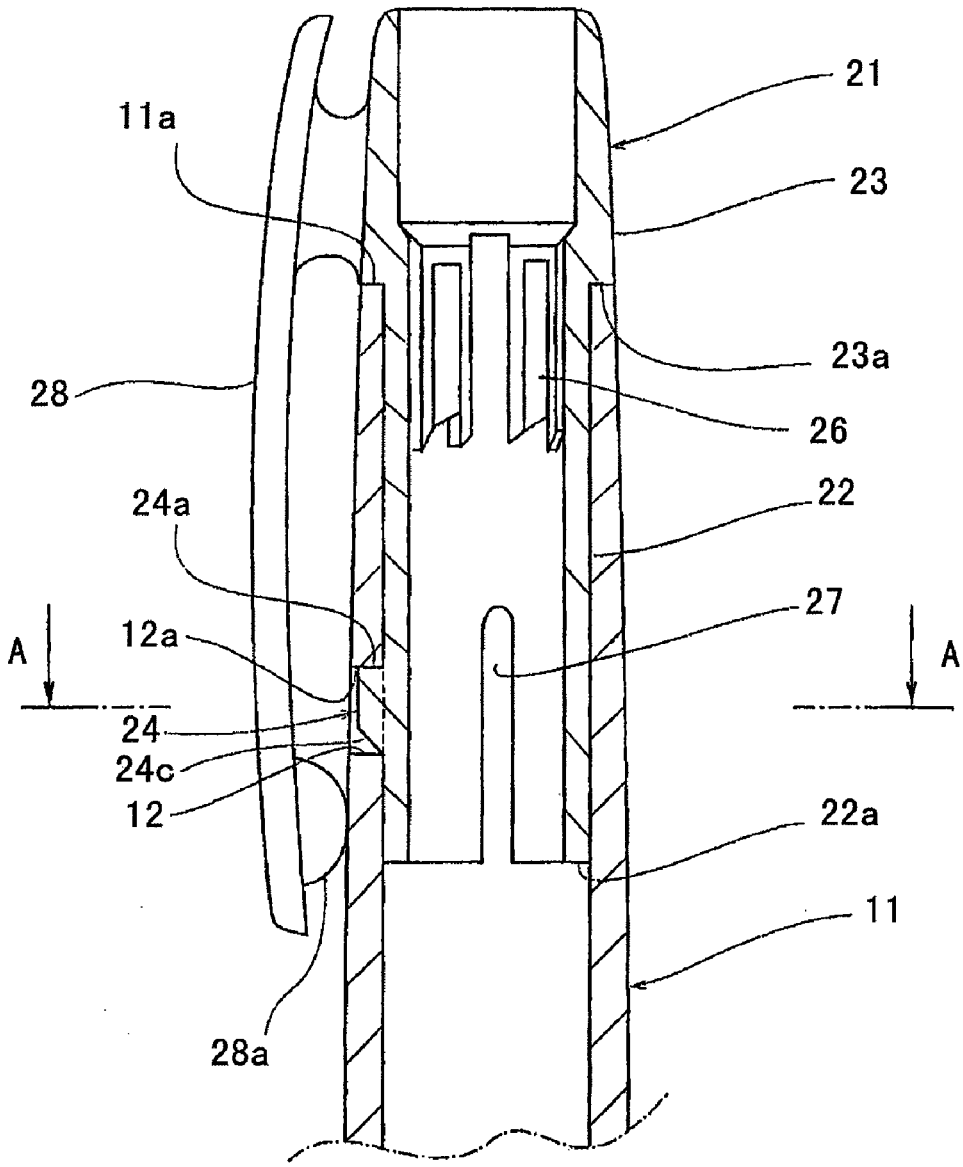
FIG. 2 is a longitudinal sectional view around the end plug for writing instrument with the mounting structure.

As shown in FIG. 1 and FIG. 2, the end plug mounting structure for writing instrument of the present invention is a structure by which an end plug 21 is assembled to rear portion on a barrel 11 for writing instrument. The barrel 11 is a molded production of resin, but can be made of any material suitable for a barrel of a writing instrument, and rear portion of the barrel 11 is cylindrical. Around the cylindrical rear portion, a predetermined space is disposed at rear end 11*a* thereof and a locking hole 12 with square section is provided to go through inner space of the cylindrical rear portion from outside thereof.

As shown in FIG. 2, the end plug 21 assembled on the rear portion of the barrel 11 comprises: an inserting portion 22, inserted in the circular cross section of rear portion of the barrel 11 from rear end 11*a* thereof; and a increased diameter portion 23, which is disposed coaxially with the inserting portion 22, extends from the inserting portion 22 and is configured integrally with the inserting portion. The increased diameter portion 23 of the present embodiment is configured with the same diameter as that of rear portion of the barrel 11, and if in the case where the inserting portion 22 is inserted in rear portion of the barrel 11, front end 23*a* of the increased diameter portion 23 is configured to contact against rear end 11*a* of the barrel 11, periphery of the increased diameter portion 23 extends smoothly from periphery of rear portion of the barrel 11.

A locking protrusion 24, which is locked in the locking hole 12 in the case where front end 23*a* of the increased diameter portion 23 contacts against rear end 11*a* of the barrel 11, is configured on the periphery of the inserting portion 22 of the end plug 21, and the locking protrusion 24 is configured with rear end face 24*a* thereof standing up in right angle with respect to the inserting portion 22, and rear end face 24*a* is configured with a predetermined space from front end 23*a* of the increased diameter portion 23. On the other hand, front end face 24*c* of the locking protrusion 24 is configured as a slope so as to be facilitated to be inserted easily into a groove 13 described below, and width in circumferential direction of the locking protrusion 24 is slightly smaller than that of the locking hole 12. Moreover, in the case where the locking protrusion 24 contacts against rear end 11*a* of the barrel 11 through front end 23*a* of the increased diameter portion 23, as is shown in FIG. 2, rear end surface 24*a* thereof comes into surface-surface contact with rear surface 12*a* of the locking hole 12 facing front to be locked in the locking hole, so as to prevent the end plug 21 from moving backward with respect to the barrel 11.

As shown in FIG. 1, on inner surface of rear portion of the barrel 11, which is inserted in the inserting portion 22 of the end plug 21, the groove 13 inside which the locking protrusion 24 is moved is configured to extend forward from rear end 11*a* of the barrel 11. The groove 13 is used for guiding the locking protrusion 24 in the locking hole 12 by means of allowing the locking protrusion 24 to be moved forward therein, so that the end plug 21 is assembled on the barrel 11 by means of allowing the locking protrusion 24 guided by the groove 13 to be locked in the locking hole 12. The structure of this embodiment is characterized by that the locking hole 12 is provided to be adjacent to the groove 13, so that the locking protrusion 24 moved forward inside the groove 13 is moved in circumferential direction so as to be locked in the locking hole 12.

In this embodiment, the groove 13 extends until the limit position of the locking protrusion 24 moved forward. That is, as is shown in FIG. 2, length of the groove 13 is determined so that in the case where front end 23*a* of the increased diameter portion 23 on the end plug 21 contacts against rear end 11*a* of the barrel 11, the locking protrusion 24 is located at front end of the groove 13 shown in FIG. 1, and the locking hole 12 is provided to be adjacent to the groove 13, as is shown in FIG. 1. Furthermore, width of the groove 13 is slightly larger than width in circumferential direction of the locking protrusion 24, and depth of the groove 13 is the same as or slightly larger than height of the locking protrusion 24.

Figure 3:
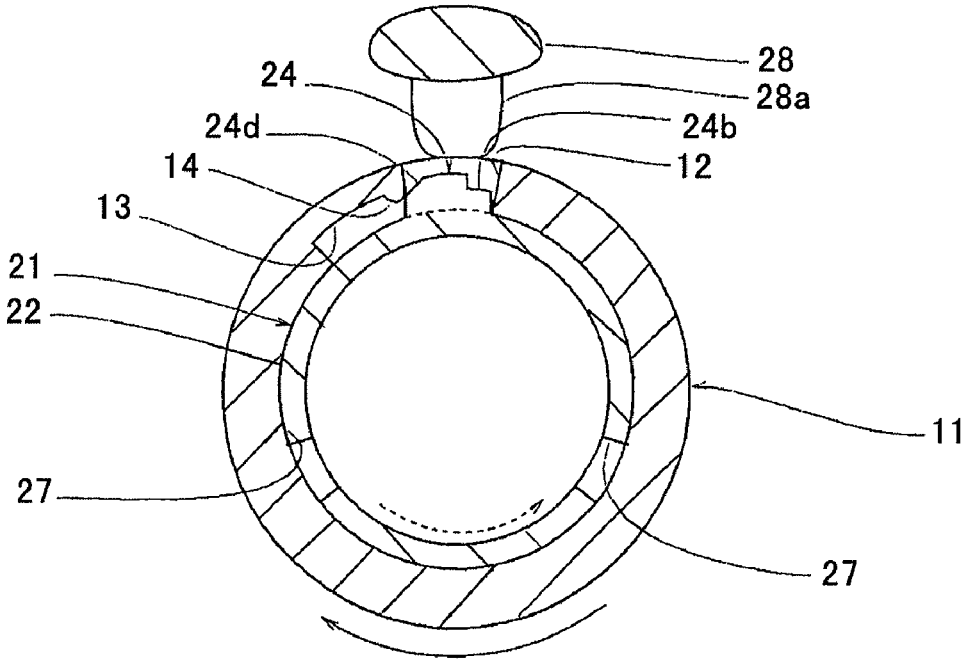
FIG. 3 is a cross-section view taken along line A-A in FIG. 2.
Figure 4:
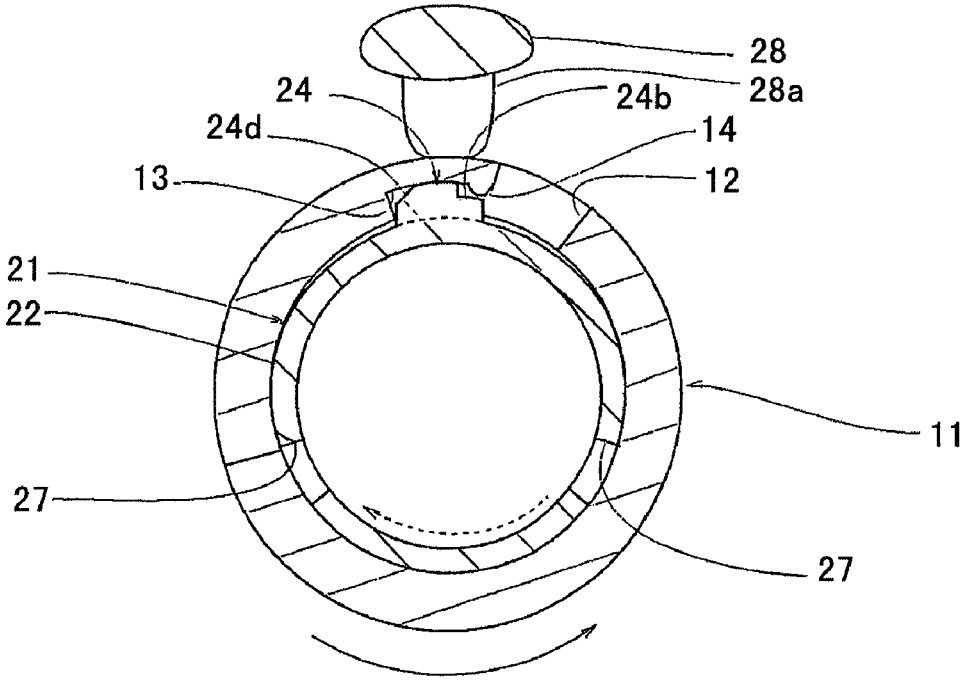
FIG. 4 is a cross-section view corresponding with FIG. 3, illustrating the state that the locking protrusion is located at front end of the groove.

As shown in FIG. 1, a protruding strip 14 extending longitudinally is provided on the bottom surface of the groove 13 on the side where the locking hole 12 is located. As is shown in detail in FIG. 3 and FIG. 4, the protruding strip 14 has a semicircular cross section, and the barrel 11 is rotated in direction indicated by a solid arrow taking central axis thereof as a pivot, or the inserting portion 22 of the end plug 21 is rotated in direction indicated by a broken line arrow taking said central axis as a pivot, so that the locking protrusion 24 strides over the protruding strip 14 with semicircular cross section to be moved in circumferential direction from the state of staying inside the groove 13 as is shown in FIG. 4. Then the locking protrusion 24 striding over the protruding strip 14 enters into the locking hole 12 from front end of the groove 13 as is shown in FIG. 3, and is locked in the locking hole as is shown in FIG. 2.

A sunken step portion 24*b* is configured on the locking protrusion 24. As shown in FIG. 4, when the locking protrusion 24 stays inside the groove 13, the portion of the sunken step portion 24*b* opposite to the protruding strip 14 is configured more lowly. Height of the sunken step portion 24*b* is low enough to avoid contacting with the protruding strip 14. In addition, when locked in the locking hole 12 as shown in FIG. 3, a corner of the locking protrusion 24 on the side of the protruding strip 14 is beveled to form a chamfer portion 24*d*. Thus, the barrel 11 is rotated in the reverse direction indicated by a solid arrow taking central axis thereof as a pivot, or the inserting portion 22 of the end plug 21 is rotated in the reverse direction indicated by a broken line arrow taking said central axis as a pivot, so that the locking protrusion 24 is moved in reverse circumferential direction and strides over the protruding strip 14 with the protruding strip 14 guided on the chamfer portion 24*d*, from the state of the locking protrusion 24 locked in the locking hole 12 as shown in FIG. 3. Then, the locking protrusion 24 striding over the protruding strip 14 is returned to the groove 13 from the locking hole 12, so as to release the locking state that the locking protrusion 24 is locked in the locking hole 12.

Return to FIG. 2, the end plug 21 in this embodiment is shown as an example of an end plug for a knock-type ball-point pen, whose inserting portion 22 is configured to be cylindrical. Therefore, a rotating cam, which is not shown and has been known in prior art, will be inserted in the end plug 21, and rear end of a ball-point pen refill will be assembled on the not shown rotating cam. Furthermore, a cam groove 26 cooperating with the not shown rotating cam is provided on rear portion of the inserting portion 22 of the end plug 21. Since the configuration of the cam groove 26 is known in the art, its detailed description will be omitted.

On the other hand, on the cylindrical inserting portion 22 of the end plug 21, a cut groove 27 extending backward from front end 22*a* of the inserting portion 22 is configured so as to allow the diameter of the inserting portion 22 to be reduced. In this embodiment, two cut grooves 27 are configured on tow positions, with depth of each cut groove 27 starting from front end 22*a* of the inserting portion 22 beyond rear end face 24*a* of the locking protrusion 24. Thus, under exterior pressure applied by the locking protrusion 24 when striding over the protruding strip 14, or in the case such as where depth of the groove 13 is lower than height of the locking protrusion 24, the cut groove 27 is narrowed, and thereby the outside diameter of the cylindrical inserting portion 22 can be reduced. As a result, the locking protrusion 24 can stride over the protruding strip 14 relatively smoothly, and after the stage that the locking protrusion 24 entering into the locking hole 12, width of the cut groove 27 can be expanded by elasticity and the outside diameter of the cylindrical inserting portion 22 can be restored, and thereby the locking protrusion 24 can be securely locked in the locking hole 12.

As shown in FIG. 2, since the end plug 21 is used for writing instrument, a clip 28 is configured on the increased diameter portion 23 of the end plug 21 for securing writing instrument on such as a pocket of Western-style clothes. In the present embodiment, the end plug is a molded production with the inserting portion 22, the increased diameter portion 23 and the clip 28 molded integrally. Rear portion of the clip 28 is connected with the increased diameter portion 23, and front end thereof is configured to extend along the inserting portion 22, striding over the locking protrusion 24. A bulge portion 28*a* is provided on front end of the clip 28 striding over the locking protrusion 24. The bulge portion 28*a* contacts with the exterior surface of the barrel 11 by elasticity with the inserting portion 22 inserted therein. Furthermore, as shown in FIG. 3, width of the portion of the clip 28 opposite to the locking protrusion 24 is wider than that of the locking protrusion 24; therefore, the clip can be configured integrally with the end plug 21 by means of covering the locking protrusion 24.

In the end plug mounting structure configured as such, since the locking hole 12 is adjacent to the groove 13 so that the locking protrusion 24 moved forward inside the groove 13 can be moved in circumferential direction to be locked in the locking hole 12, as indicated by the solid arrow in FIG. 1, the inserting portion 22 of the end plug 21 is inserted from rear end 11*a* of the barrel 11 to move the locking protrusion 24 in the groove 13 in front direction, and then the end plug 21 or the barrel 11 is rotated, thereby the locking protrusion 24 can be locked in the locking hole 12 only by such relatively easy operation that moves the locking protrusion 24 in circumferential direction.

In particular, in the present embodiment, since the locking protrusion 24 is located in front end of the groove 13, and the locking hole 12 is configured to be adjacent to front end of the groove 13 in the case where front end 23*a* of the increased diameter portion 23 provided on the end plug 21 contacts against rear end 11*a* of the barrel 11, the end plug 21 or the barrel 11 can be rotated with a central axis thereof as a pivot so that the locking protrusion 24 can be locked in the locking hole 12 in the case where front end 23*a* of the increased diameter portion 23 contacts against the rear end 11*a* of the barrel 11. As a result, the end plug 21 can be more easily assembled on the barrel 11.

On the other hand, as shown in FIG. 3, if the end plug 21 is rotated in reverse direction with a central axis thereof as a pivot from the case where the locking protrusion 24 is locked in the locking hole, the locking protrusion 24 is moved in reverse direction of the circumferential direction to return into the groove 13 from the locking hole 12, so that the state that the locking protrusion 24 is locked in the locking hole 12 can be more easily released. Thereby, if the end plug 21 is moved backward along the direction indicated by the broken line in FIG. 1, from the case that the locking protrusion 24 is returned into the groove 13 as shown in FIG. 4, the locking protrusion 24 will be moved backward inside the groove 13 so that the end plug 21 can be removed more easily from the barrel 11.

Thus, as is shown in the present embodiment, if the writing instrument is a ball-point pen, the ball-point pen refill which is not shown can be pulled out form rear portion of the barrel, and the replacement of the refill can be carried out from rear portion of the barrel 11 by inserting a new ball-point pen refill from rear portion of the barrel. In this case, a writing tip assembled at the front end of the barrel 11 for replacing a ball-point pen refill can be eliminated. Moreover, since the rotating cam, which cooperates with the cam groove 26 and is not shown, is removed together with the end plug 21, losing of the rotating cam can be avoided during replacement of a ball-point pen refill.

Hereinafter, in the mounting structure according to the embodiment, since the locking protrusion 24 is moved along circumferential direction to be locked in the locking hole 12, and is moved along reverse direction of the circumferential direction to release the locking state, there is no need for the end plug to be moved backward in the lengthwise direction along the barrel after the locking protrusion pressed into the barrel as before. Therefore, in prior art, if the locking protrusion is not fully pressed into the barrel, the end plug can not be moved backward. However, in the mounting structure according to the present invention, even if the assembling and the removing of the end plug is performed repeatedly, the rear surface 12*a* of the locking hole 12 and rear end face 24*a* of the locking protrusion in face-face contact with rear surface 12*a* are not distorted. Therefore, weakening of tightness for the end plug 21 assembled on the barrel 11 caused by distortion of rear surface 24*a* of the locking hole 12 and rear end face 24*a* of the locking protrusion 24 can be prevented.

In addition, since the protruding strip 14 extending along lengthwise direction is provided on the bottom surface of the groove 13 on the side of the locking hole 12, and the locking protrusion 24 is configured to be locked in the locking hole 12 or released from the locking state by means of striding over of the protruding strip 14 to be moved in circumferential direction in the groove 13, feeling of certainty for movement along circumferential direction of the locking protrusion 24, which is desirable when assembling and removing is performed, can be provided. Therefore, the state that the locking protrusion 24 is locked in the locking hole 12 as shown in FIG. 3 and the state that the locking is released as shown in FIG. 4 can be distinguished definitely.

Furthermore, since the sunken step portion 24*b* is provided on the locking protrusion 24 to avoid contacting with the protruding strip 14, wearing of the protruding strip 14 caused by contacting against the locking protrusion 24, which is moved inside the groove 13, during assembling and removing of the end plug 21 can be avoided. Therefore, even if the movement along circumferential direction of the locking protrusion 24 for assembling and removing is performed repeatedly, variation of the feeling of certainty for movement along circumferential direction can be avoided. Moreover, since the inserting portion 22 is cylindrical, and the cut groove 27 extending backward from front end 22*a* of the inserting portion 22 is configured to allow for reducing the diameter of the inserting portion 22, width of the cut groove 27 is narrowed by exterior pressure applied during the locking protrusion striding over the protruding strip 14, and thereby, outside diameter of the cylindrical inserting portion 22 can be reduced. As a result, the locking protrusion can stride over the protruding strip 14 more smoothly, the movement along circumferential direction of the locking protrusion 24 is getting easier, and excessive wearing of the locking protrusion 24 and the protruding strip 14 caused by assembling and removing of the end plug 21 repeatedly can be avoided effectively. Furthermore, since the clip 28 is provide on the end plug 21 by means of covering the locking protrusion 24, in the case where the locking protrusion 24 is locked in the locking hole 12, the locking hole 12 together with the locking protrusion 24 is covered by the clip 28, therefore, the beauty of the appearance will not be influenced without exposure of the locking hole 12.

Figure 5:
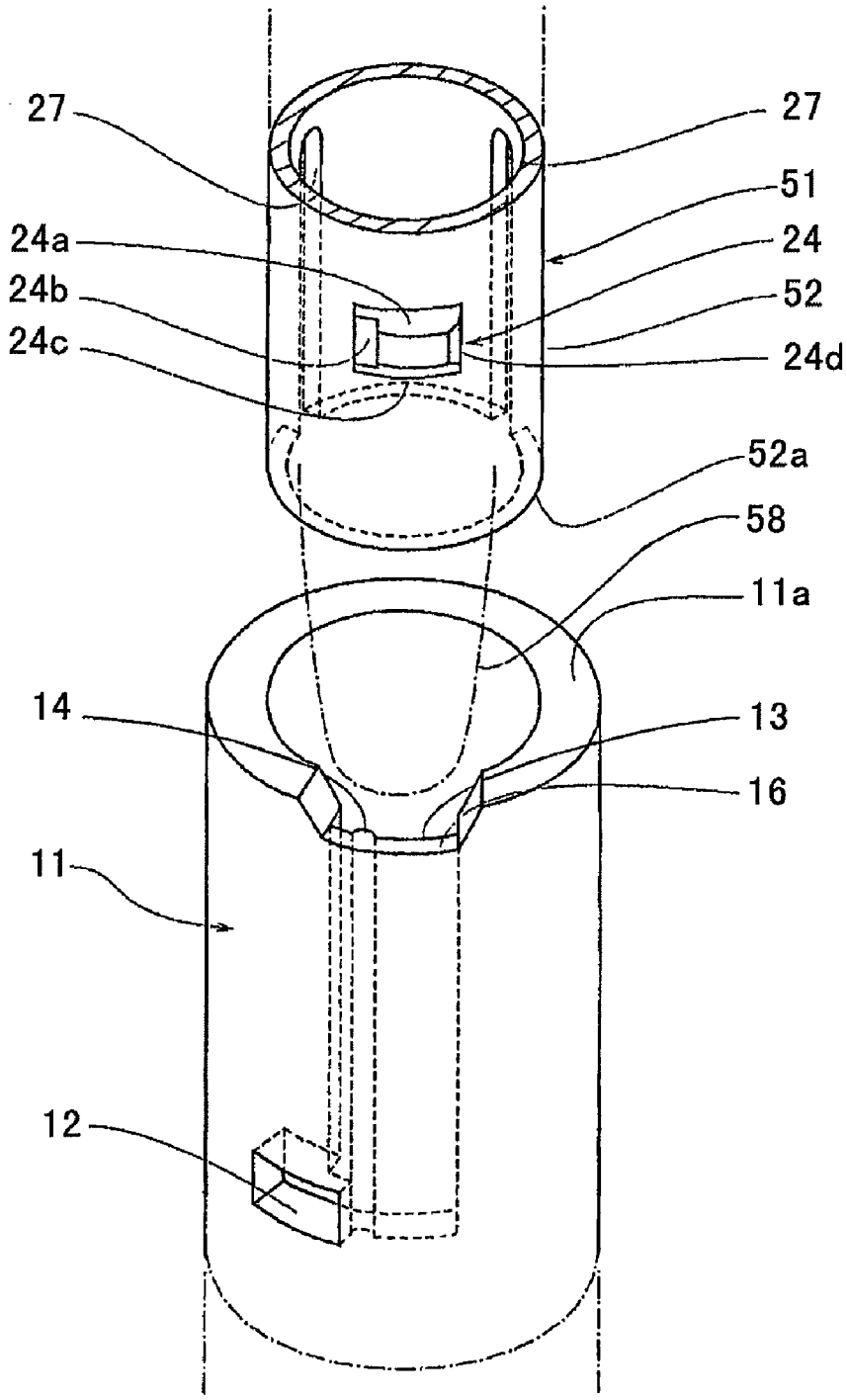
FIG. 5 is an exploded perspective view showing an alternative embodiment of the end plug mounting structure for writing instrument according to an aspect of the present disclosure.
Figure 6:
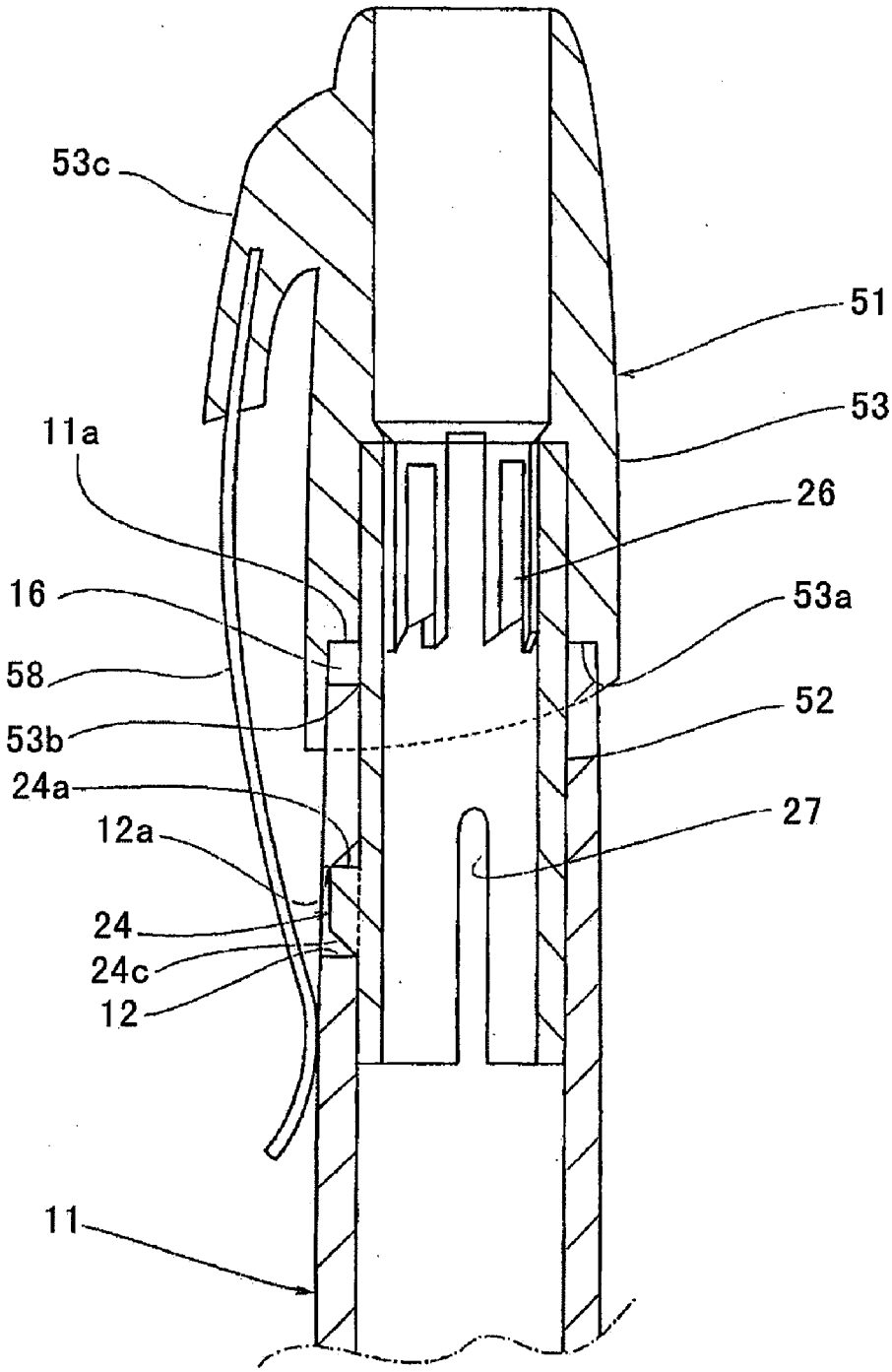
FIG. 6 is a longitudinal sectional view around the end plug for writing instrument with the mounting structure.

An alternative embodiment according to the present invention is shown in FIG. 5 and FIG. 6. In this embodiment, the same parts or components are indicated by the same reference numbers, and redundant description thereof will be omitted.

A barrel 11 in this embodiment is provided with a cylindrical rear portion, and a groove 13 extending forward from a rear end 11*a* of the barrel 11 to allow for movement of the locking protrusion is provided on inner surface of rear portion of the barrel 11. Moreover, a locking hole 12 adjacent to the groove 13 is configured around rear portion of the barrel 11, which is used for locking the locking protrusion moved forward in the groove 13 and then moved along circumferential direction. Since all those components are the same as in the above embodiment, redundant description thereof will be omitted. Furthermore, a slot 16 running from the groove 13 is provided at rear end 11*a* of the barrel 11. The slot 16 is configured to be narrowed in width gradually in front direction. Front end of the slot 16 with narrowed width runs smoothly from the groove at the position where the groove has the same width as that of front end of the slot 16.

On the other hand, as shown in FIG. 6, an end plug 51 is respectively provided with an inserting portion 52, a increased diameter portion 53 and a clip 58, and the inserting portion 52 and the increased diameter portion 53 are made of molded production. The inserting portion is configured to be cylindrical, and a locking protrusion 24, a cam groove 26 and a cut groove 27 are provided on the inserting portion 52. Those components are the same as those in the above embodiment, and the redundant description thereof will be reduced.

A rear portion, into which the inserting portion 52 is mounted, is inserted in a front portion of the increased diameter portion 53, and thereby the increased diameter portion 53 is disposed coaxially with the inserting portion, and is configured to run from rear portion of the inserting portion 52. The outside diameter of the increased diameter portion 53 is larger than that of rear portion of the barrel 11, and a front end 53*a* is provided to contact against rear end 11*a* of the barrel 11 in the case where the locking protrusion 24 is locked in the locking hole 12. Moreover, a covering portion 53*b* is provided on the increased diameter portion 53, and the covering portion 53*b* clips the slot 16 together with periphery of the inserting portion 52 therein, and covers the slot 16 in the case where front end 53*a* of the increased diameter portion 53 contacts against rear end 11*a* of the barrel 11.

On the increased diameter portion 53 behind the locking protrusion 24, a protruding portion 53*c* is configured with the protruding front end facing front direction, and a rear portion of the clip 58 is assembled on front end facing front direction of the protruding portion 53*c*. The clip 58 is made of metal, and width of a portion of the clip 58 opposite to the locking protrusion 24 is wider than that of the locking protrusion 24. Thereby, the clip 58 is provided on the end plug 51 by means of covering the locking protrusion 24. On the other hand, as is shown in FIG. 5, front end of the clip 58 striding over the locking protrusion 24 is provided corresponding to the slot 16, so that if front end of the clip 58 matches with the slot 16, the locking protrusion 24 covered by the clip 58 is located behind the groove 13 extending from the slot 16.

In the end plug mounting structure for writing instrument configured as such, besides the functions and effects described in the previous embodiment, the following functions and effects can also be produced.

In this embodiment, since the slot 16 running from the groove 13 at the front end thereof is provided on rear end 11*a* of the barrel 11, the position of the groove 13, which is difficult to be determined by the naked eye from outside, can be determined by utilizing the slot 16. Since width of the slot 16 is narrowed in front direction, if the locking protrusion 24 is inserted from the slot 16, the locking protrusion 24 can be guided to the groove 13 more easily through incline of both sides of the slot 16 with width narrowed in front direction. In particular in this embodiment, since the clip extending along the barrel 11 and covering the locking protrusion 24 is provided on the end plug 51, and front end of the clip 58 is configured to correspond to the slot 16, to match front end of the clip 58 and the slot 16, the locking protrusion 24 covered by the clip 58 is located behind the groove 13 running from the slot 16. Therefore, in the case where front end of the clip 58 is matched with the slot 16, the locking protrusion 24 can be securely guided to the groove 13 only through such simple operation of moving the end plug 51 forward.

In addition, since the covering portion 53*b* that covers the slot 16 is provided on the increased diameter portion 53 under the state that the locking protrusion 24 is locked in the locking hole 12, exposure of the slot 16 can be avoided, thus beauty of appearance is improved. Moreover, since the clip 58 is provided on the end plug 51 by means of covering the locking protrusion 24, in the state that the locking protrusion 24 is locked in the locking hole 12, the clip 58 covers the locking hole 12 together with the locking protrusion 24, the esthetics of the writing instrument will not be influenced by exposure of the locking hole 12.

In addition, in above embodiment, although the configuration for assembling the end plug 21 or 51 on the barrel 11 is described as an example used for a knock-type ball-point pen, the mounting structure of the present disclosure can be used for a mechanical pencil and other writing instruments. Moreover, if the mounting structure of the present invention is utilized in a mechanical pencil, the end plug assembled on rear portion of the barrel can be removed from rear portion to perform assembling of a replacing refill from rear portion of the barrel.

The above specification, examples and data provide a complete description of the manufacture and use of the composition of the invention. Since many embodiments of the invention can be made without departing from the spirit and scope of the invention, the invention resides in the claims hereinafter appended.

What is claimed is:

1. An end plug mounting structure for writing instrument, comprising:

a barrel having a cylindrical rear portion having a periphery defining a locking hole;

an inserting portion with a circle cross section provided on said end plug, the inserting portion having a periphery inserted into said rear portion of the barrel from a rear end of the barrel; and a locking protrusion provided on the periphery of said inserting portion, said locking protrusion locked in said locking hole;

said rear portion of the barrel further having an inner surface defining a groove extending forward from said rear end of the barrel, in which said locking protrusion moves, whereby said end plug is capable of being assembled on the barrel by means of locking said locking protrusion that moves forward in said groove in said locking hole;

wherein said locking hole is configured to be adjacent to said groove, so that said locking protrusion moving forward in said groove moves along circumferential direction so as to be locked in said locking hole.

2. The end plug mounting structure for writing instrument according to claim 1, wherein a protruding strip extending in lengthwise direction is provided on bottom surface of said groove on the side of said locking hole, and said locking protrusion is configured to stride over said protruding strip to move in circumferential direction.

3. The end plug mounting structure for writing instrument according to claim 2, wherein a sunken step portion is provided on said locking protrusion to avoid contacting with said protruding strip.

4. The end plug mounting structure for writing instrument according to claim 1, wherein said inserting portion is configured to be cylindrical, and wherein a cut groove is configured to extend backward from front end of said inserting portion.

5. The end plug mounting structure for writing instrument according to claim 2, wherein said inserting portion is configured to be cylindrical, and wherein a cut groove is configured to extend backward from front end of said inserting portion.

6. The end plug mounting structure for writing instrument according to claim 3, wherein said inserting portion is configured to be cylindrical, and wherein a cut groove is configured to extend backward from front end of said inserting portion.

7. The end plug mounting structure for writing instrument according to claim 1, wherein a slot extending from said groove is provided at said rear end of the barrel.

8. The end plug mounting structure for writing instrument according to claim 7, wherein a increased diameter portion with front end thereof contacting against said rear end of the barrel is provided coaxially with said inserting portion and configured to extend from said inserting portion in the case where said locking protrusion is locked in said locking hole, and wherein a covering portion for covering said slot is provided on said increased diameter portion in the case where front end of said increased diameter portion contacts against said rear end of the barrel.

9. The end plug mounting structure for writing instrument according to claim 1, wherein a clip for covering said locking protrusion is provided on said end plug.

* * * * *